US009240151B2

(12) United States Patent
Hung et al.

(10) Patent No.: US 9,240,151 B2
(45) Date of Patent: Jan. 19, 2016

(54) SOURCE DRIVER AND METHOD FOR DETERMINING POLARITY OF PIXEL VOLTAGE THEREOF

(71) Applicant: Novatek Microelectronics Corp., Hsinchu (TW)

(72) Inventors: Pang-Chen Hung, Hsinchu County (TW); Jhih-Siou Cheng, New Taipei (TW); Hung-Cheng Hsiao, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 142 days.

(21) Appl. No.: 14/047,037

(22) Filed: Oct. 7, 2013

(65) Prior Publication Data

US 2015/0042629 A1 Feb. 12, 2015

(30) Foreign Application Priority Data

Aug. 12, 2013 (TW) ..... 102128856 A

(51) Int. Cl.
*G09G 3/36* (2006.01)

(52) U.S. Cl.
CPC ..... *G09G 3/3614* (2013.01); *G09G 3/3688* (2013.01); *G09G 2310/0297* (2013.01)

(58) Field of Classification Search
CPC ..... G09G 3/3696; G09G 3/367; G09G 3/348; G09G 3/3688
See application file for complete search history.

(56) References Cited

U.S. PATENT DOCUMENTS

| | | | | |
|---|---|---|---|---|
| 8,169,397 | B2 * | 5/2012 | Park | 345/101 |
| 8,736,532 | B2 | 5/2014 | Oh | |
| 8,941,632 | B2 | 1/2015 | Kim et al. | |
| 9,099,054 | B2 | 8/2015 | Kim | |
| 2002/0186193 | A1 * | 12/2002 | Lee et al. | 345/96 |
| 2005/0168425 | A1 * | 8/2005 | Takada et al. | 345/94 |
| 2006/0097967 | A1 * | 5/2006 | Lee | 345/87 |
| 2007/0046601 | A1 * | 3/2007 | Shin et al. | 345/89 |

(Continued)

FOREIGN PATENT DOCUMENTS

| | | |
|---|---|---|
| TW | 201222510 | 6/2012 |
| TW | 201227678 | 7/2012 |

(Continued)

OTHER PUBLICATIONS

"Office Action of Taiwan Counterpart Application," issued on Oct. 15, 2015, p. 1-7.

*Primary Examiner* — Ricardo L Osorio
(74) *Attorney, Agent, or Firm* — Jianq Chyun IP Office

(57) ABSTRACT

A source driver and a method for determining polarity of pixel voltage thereof are provided. The source driver includes a data register unit, a plurality of data groups and a plurality of polarity determining units. The data register unit receives an image data signal and provides a plurality of display data. The data groups have at least two data channels respectively. The data channels are coupled to the data register unit to receive the corresponding display data and provide a plurality of pixel voltages. The polarity determining units are respectively coupled to the data channels corresponding to different data groups, and each of the polarity determining units determines whether to invert polarities of a part of the pixel voltages provided by the coupled data channels according to the received display data of the coupled data channels and previous display data corresponding to the received display data.

15 Claims, 8 Drawing Sheets

(56) References Cited

U.S. PATENT DOCUMENTS

| | | | | |
|---|---|---|---|---|
| 2008/0158129 | A1* | 7/2008 | Murakami et al. | 345/98 |
| 2008/0170024 | A1* | 7/2008 | Song et al. | 345/96 |
| 2008/0180427 | A1* | 7/2008 | Nishimura | 345/209 |
| 2009/0102831 | A1* | 4/2009 | Hashimoto | 345/214 |
| 2010/0046598 | A1* | 2/2010 | Zhong et al. | 375/233 |
| 2010/0123702 | A1 | 5/2010 | Kim | |
| 2010/0265410 | A1* | 10/2010 | Sugihara et al. | 348/731 |
| 2010/0295833 | A1* | 11/2010 | Nishio et al. | 345/207 |
| 2011/0285759 | A1* | 11/2011 | Sakai | 345/690 |
| 2011/0292012 | A1 | 12/2011 | Huang et al. | |
| 2012/0133628 | A1 | 5/2012 | Kim et al. | |
| 2012/0162178 | A1 | 6/2012 | Oh | |
| 2012/0169784 | A1 | 7/2012 | Lee | |
| 2012/0249603 | A1* | 10/2012 | Ban et al. | 345/690 |
| 2013/0083093 | A1* | 4/2013 | Kim | 345/690 |
| 2013/0141320 | A1 | 6/2013 | Kim | |
| 2015/0015567 | A1* | 1/2015 | Fujioka et al. | 345/214 |

FOREIGN PATENT DOCUMENTS

| | | |
|---|---|---|
| TW | 201324491 | 6/2013 |
| TW | 201331905 | 8/2013 |

* cited by examiner

SOURCE DRIVER AND METHOD FOR DETERMINING POLARITY OF PIXEL VOLTAGE THEREOF

CROSS-REFERENCE TO RELATED APPLICATION

This application claims the priority benefit of Taiwan application serial no. 102128856, filed on Aug. 12, 2013. The entirety of the above-mentioned patent application is hereby incorporated by reference herein and made a part of this specification.

BACKGROUND OF THE INVENTION

1. Field of the Invention

The invention relates to a driving device of a display, and more particularly, relates to a source driver and a method for determining polarity of pixel voltage thereof.

2. Description of Related Art

In recent years, liquid crystal displays have become a mainstream in the market due to its advantages such as low power consumption, absence of radiation, and high space utilization. In a driving circuit of a display, a source driver is an indispensable element configured to convert a digital image data signal into a pixel voltage and to provide the pixel voltage to the pixel being activated, so that the pixel voltage can be stored in the a storage capacitor formed by the a pixel electrode and a common electrode.

Since the pixel voltage varies with grayscale (i.e., brightness) pending to be displayed, and a variation of a voltage level can be conducted to the common electrode through a capacitance coupling effect of the storage capacitor, such that the voltage level of the common electrode (i.e., a common voltage) is influenced, thereby affecting a display performance of pixels. Further, as sizes of the liquid crystal displays become larger, a size of a liquid crystal display panel is also increased, which results in a number of the pixel voltages provided by the source driver to increase. Accordingly, how to avoid the common voltage from being influenced b the variation of the pixel voltage is gradually becoming an important topic to be discussed.

In addition, in order to reduce a power consumption of the source driver, a charge sharing technology is applied in transmitting the pixel voltage to the liquid crystal display panel. However, the charge sharing technology in a conventional art is generally used in the source driver which generates the pixel voltage by utilizing a dot inversion driving method. However, with continuous advancements of display technologies, driving methods for the source driver are also advanced, so that the charge sharing technology is incapable of reducing the power consumption of the source driver. Therefore, it requires a new charge sharing technology in order to reduce the power consumption of the source driver adopting the new driving methods.

SUMMARY OF THE INVENTION

The invention is directed to a source driver and a method for determining polarity of pixel voltage thereof, capable of improving stability of common voltage.

The source driver of the invention includes a data register unit, a plurality of data groups and a plurality of polarity determining units. The data register unit receives an image data signal and provides a plurality of display data. The data groups have at least two data channels respectively. The data channels are coupled to the data register unit to receive the corresponding display data and provide a plurality of pixel voltages. The polarity determining units are respectively coupled to the data channels corresponding to different data groups, and each of the polarity determining units determines whether to invert polarities of a part of the pixel voltages provided by the coupled data channels according to the received display data of the coupled data channels and previous display data corresponding to the received display data.

According to an embodiment of the invention, when preset charging directions of the pixel voltages of the corresponding data groups determined by each of the polarity determining units according to the received display data of the coupled data channels and the previous display data corresponding to the received display data are completely identical, each of the polarity determining units inverts the polarities of the part of the pixel voltages provided by the coupled data channels. When the preset charging directions of the pixel voltages of the corresponding data groups determined by each of the polarity determining units according to the received display data of the coupled data channels and the previous display data corresponding to the received display data are not completely identical, each of the polarity determining units does not invert the polarities of the part of the pixel voltages provided by the coupled data channels.

According to an embodiment of the invention, when each of the data groups includes an even number of data channels, each of the polarity determining units inverts the polarities of a half of the pixel voltages provided by the coupled data channels.

When each of the data groups includes an odd number of data channels, each of the polarity determining units inverts the polarities of a n number of the pixel voltages provided by the coupled data channels, in which n is a positive integer close to a half of a number of the data channels included in each of the data groups.

According to an embodiment of the invention, each of the data channels respectively receives two display data and respectively provides two corresponding pixel voltages, and the polarities of the pixel voltages provided by each of the data channels are different from each other.

According to an embodiment of the invention, each of the data channels includes a first latch, a second latch, a first exchanging unit, a third latch, a fourth latch, a first digital-to-analog converter, a second digital-to-analog converter, a second exchanging unit, a first buffer, a second buffer, a first switch and a second switch. An input terminal of the first latch is coupled to the data register unit to receive the corresponding display data, and an output terminal of the first latch is coupled to the corresponding polarity determining unit to provide the display data received by each of the data channels. An input terminal of the second latch is coupled to the data register unit to receive the corresponding display data, and an output terminal of the second latch is coupled to the corresponding polarity determining unit to provide the display data received by each of the data channels. The first exchanging unit has a first input terminal, a second input terminal, a first output terminal and a second output terminal, and receives a polarity control signal provided by the polarity determining unit, the first input terminal being coupled to the output terminal of the first latch, the second input terminal being coupled to the output terminal of the second latch. According to the polarity control signal, the first exchanging unit controls the first input terminal and the second input terminal to couple the first output terminal and the second output terminal, respectively, or controls the first input terminal and the second input terminal to couple the second output terminal and the first output terminal, respectively. An input terminal of the third latch is coupled to the first output terminal to receive the corresponding display data, and an output terminal of the third latch is coupled to the corresponding polarity determining unit to provide the corresponding previous display data. An input terminal of the fourth latch is coupled to the second output terminal to receive the corresponding display data, and an output terminal of the fourth latch is coupled to the corresponding polarity determining unit to provide the corresponding previous display data. An input terminal of the first digital-to-analog converter is coupled to the output terminal of the third latch to receive the corresponding display data and provide the pixel voltages having a first polarity. An input terminal of the second digital-to-analog converter is coupled to the output terminal of the fourth latch to receive the corresponding display data and provide the pixel voltages having a second polarity. The second exchanging unit has a third input terminal, a fourth input terminal, a third output terminal and a fourth output terminal, and receives the polarity control signal, the third input terminal being coupled to the output terminal of the first digital-to-analog converter, the fourth input terminal being coupled to the output terminal of the second digital-to-analog converter. According to the polarity control signal, the second exchanging unit controls the third input terminal and the fourth input terminal to couple the third output terminal and the fourth output terminal, respectively, or controls the third input terminal and the fourth input terminal to couple the fourth output terminal and the third output terminal, respectively. An input terminal of the first buffer is coupled to the third output terminal to buffer the received pixel voltages. An input terminal of the second buffer is coupled to the fourth output terminal to buffer the received pixel voltages. The first switch is coupled to the first buffer and receives a latch signal so as to output the received pixel voltages under control of the latch signal. The second switch is coupled to the second buffer and receives the latch signal so as to output the received pixel voltages under control of the latch signal.

In the present embodiment, the source driver further includes a plurality of charge sharing units. The charge sharing units are coupled to the output terminals of the data channels corresponding to different data groups, respectively, and coupled to the corresponding polarity determining unit. Therein, each of the polarity determining units determines whether to enable the corresponding charge sharing unit to execute a charge sharing function according to the preset charging directions of the pixel voltages of the corresponding data groups determined according to the received display data of the coupled data channels and the previous display data corresponding to the received display data.

According to an embodiment of the invention, each of the charge sharing units includes a plurality of charge sharing switches respectively coupled between the output terminals of the data channels of the corresponding data groups, and being simultaneously turned on under control of the corresponding polarity determining unit.

The invention also provides a method for determining polarity of pixel voltage of source driver, which includes the following steps: providing a plurality of display data according to an image data signal; providing a plurality of pixel voltages according to the display data, in which the pixel voltages corresponds to a plurality of data groups, respectively, and each of the data groups at least corresponds to two of the pixel voltages; determining a polarity of each of the pixel voltages; and determining whether to invert the polarities of a part of the pixel voltages corresponding to each of the data groups according to the display data corresponding to the each of the data groups and a plurality of previous display data corresponding to the display data.

According to an embodiment of the invention, the step of determining whether to invert the polarities of a part of the pixel voltages corresponding to each of the data groups according to the display data corresponding to the each of the data groups and a plurality of previous display data corresponding to the display data includes: inverting the polarities of the part of the pixel voltages of each of the data groups when the display data corresponding to each of the data groups and the previous display data corresponding to the display data both showing that preset charging directions of the pixel voltages corresponding to each of the data groups are completely identical; and do not inverting the polarities of the part of the pixel voltages of each of the data groups when the display data corresponding to each of the data groups and the previous display data corresponding to the display data both showing that the preset charging directions of the pixel voltages corresponding to each of the data groups are not completely identical.

According to an embodiment of the invention, the method for determining polarity of pixel voltage of source driver further includes: when each of the data groups corresponds to an even number of the pixel voltages, the pixel voltages being inverted is a half of the even number of the pixel voltages.

According to an embodiment of the invention, the method for determining polarity of pixel voltage of source driver further includes: when each of the data groups corresponds to an odd number of pixel voltages, the pixel voltages being inverted is a n number of the odd number of the pixel voltages, in which n is a positive integer close to a half of a number of the pixel voltages corresponding to each of the data groups.

According to an embodiment of the invention, a polarity of each of the pixel voltages and a polarity of a neighboring pixel voltage are different from each other.

According to an embodiment of the invention, the method for determining polarity of pixel voltage of source driver further includes: executing a charge sharing function to the pixel voltages corresponding to each of the data groups when the polarities of the part of pixel voltages of each of the data groups are not inverted.

Based on above, in the source driver and a method for determining polarity of pixel voltage thereof, whether to invert the polarities of the part of the pixel voltages corresponding to each of the data groups is determined according to the display data corresponding to the each of the data groups and the previous display data corresponding to the display data. Accordingly, influences of charging the pixel voltages to the common voltage can be reduced.

To make the above features and advantages of the disclosure more comprehensible, several embodiments accompanied with drawings are described in detail as follows.

DESCRIPTION OF THE EMBODIMENTS

Figure 1A:
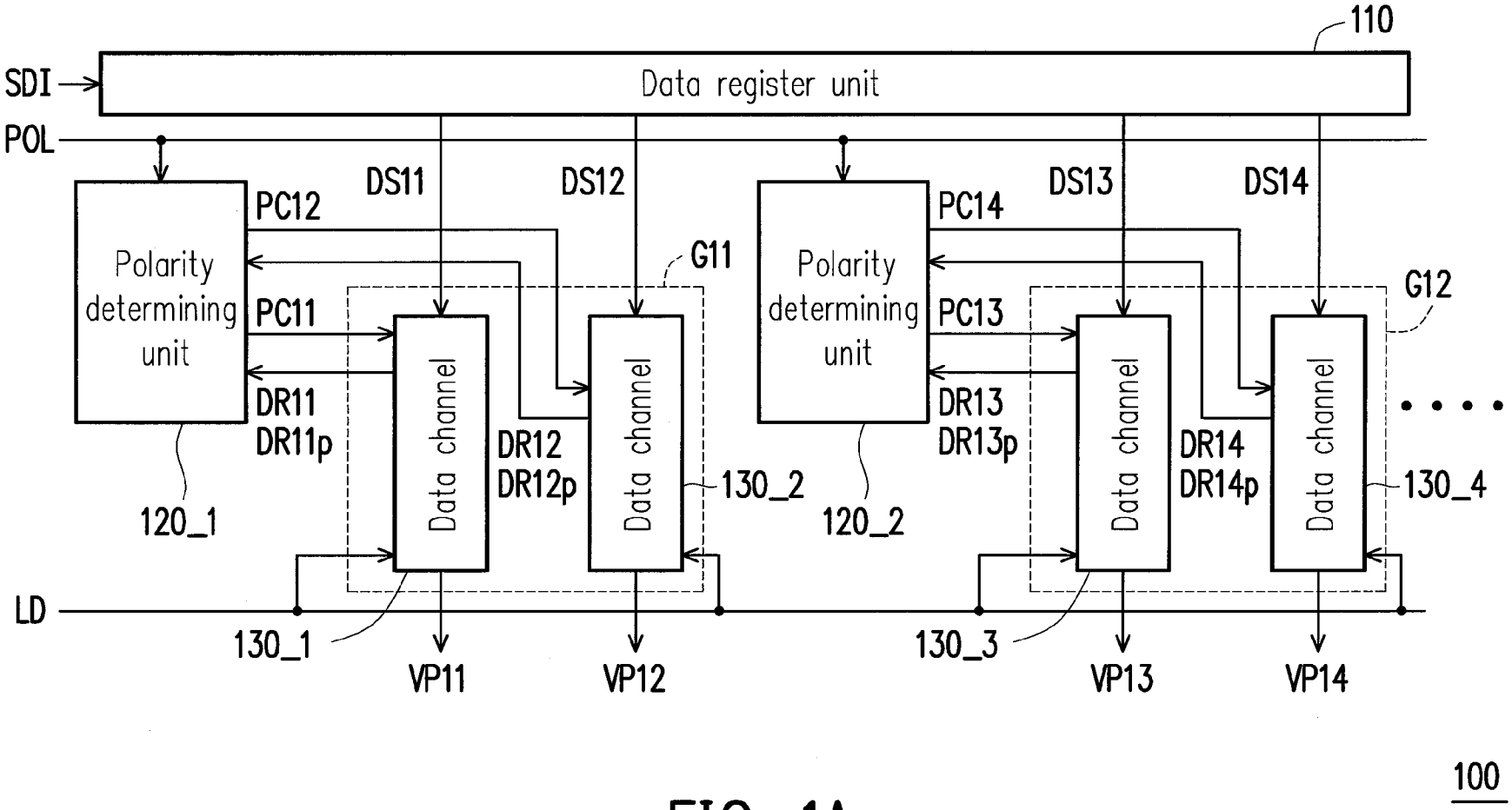
FIG. 1A is a schematic view illustrating a system of a source driver according to an embodiment of the invention.

FIG. 1A is a schematic view illustrating a system of a source driver according to an embodiment of the invention. Referring to FIG. 1A, in the present embodiment, a source driver 100 includes a data register unit 110, a plurality of polarity determining units (e.g., 120_1, 120_2) and a plurality of data channels (e.g., 130_1 to 130_4). The data channels (e.g., 130_1 to 130_4) are grouped into a plurality of data groups (e.g., G11, G12). In the present embodiment, it is illustrated with each of the data groups (e.g., G11, G12) including two data channels (e.g., 130_1 to 130_4) as an example. In other embodiments, each of the data groups (e.g., G11, G12) can include three data channels (e.g., 130_1 to 130_4) or more data channels, and the embodiment of the invention is not limited thereto.

The data register unit 110 receives an image data signal SDI, and provides a plurality of display data (e.g., DS11 to DS14) from data transmitted by the image data signal SDI being organized and arranged. The data channels (e.g., 130_1 to 130_4) is coupled to the data register unit 110 to receive the corresponding display data (e.g., DS11 to DS14) and receive a latch signal LD, so as to provide the corresponding pixel voltages (e.g., VP11 to VP14) according to the latch signal LD. Therein, a polarity of each of the pixel voltages (e.g., VP11 to VP14) and a polarity of a neighboring pixel voltage (e.g., VP11 to VP14) can be different from each other, but the embodiment of the invention is not limited thereto. For instance, the data channel 130_1 receives the display data DS11 to provide the corresponding pixel voltage VP11 and the data channel 130_2 receives the display data DS12 to provide the corresponding pixel voltage VP12, and the rest may be deduced by analogy.

The polarity determining units (e.g., 120_1, 120_2) are respectively coupled to the data channels (e.g., 130_1 to 130_4) corresponding to different data groups (e.g., G11, G12) and configured to receive a polarity signal POL. For instance, the polarity determining unit 120_1 is coupled to the data channels 130_1 and 103_2 of the corresponding data group G11, and the polarity determining unit 120_2 is coupled to the data channels 130_3 and 130_4 of the corresponding data group G12. Each of the polarity determining units (e.g., 120_1, 120_2) controls the polarities of the pixel voltages (e.g., VP11 to VP14) provided by each of the data channels (e.g., 130_1 to 130_4) through polarity control signals (e.g., PC11 to PC14), and receives reference data (e.g., DR11 to DR14) and previous reference data (e.g., DR11*p* to DR14*p*) from the data channels (e.g., 130_1 to 130_4) coupled thereto.

The reference data DR11 provided by the data channel 130_1 corresponds to the received display data DS11, and the reference data DR11 can be a part of the display data DS11 (e.g., high bit part), or the entire display data DS11. The previous reference data DR11*p* provided by the data channel 130_1 corresponds to the received previous display data DS11, and the previous reference data DR11*p* can be a part of the previous display data DS11 (e.g., high bit part), or the entire previous display data DS11. Other reference data (e.g., DR12 to DR14) and the previous reference data (e.g., DR12*p* to DR14*p*) may be deduced by analogy, but the embodiment of the invention is not limited thereto.

In the present embodiment, each of the polarity determining units (e.g., 120_1, 120_2) first determines the polarity (e.g., a positive polarity or a negative polarity) of each of the pixel voltages (e.g., VP11 to VP14) according to the polarity signal POL. Further, each of the polarity determining units (e.g., 120_1, 120_2) then determines whether the polarities of the pixel voltages (e.g., VP11 to VP14) provided by the coupled data channels (e.g., 130_1 to 130_4) require an inversion according the received reference data (e.g., DR11 to DR14) and the previous reference data (e.g., DR11*p* to DR14*p*). In other words, each of the polarity determining units (e.g., 120_1, 120_2) determines whether to inverse the polarities of a part of the pixel voltages (e.g., VP11 to VP14) provided by the coupled data channels (e.g., 130_1 to 130_4) according to the received display data (e.g., DS11 to DS14) of the coupled data channel (e.g., 130_1 to 130_4).

Furthermore, the polarity determining units (e.g., 120_1, 120_2) can determine a preset charging direction of each of the pixel voltages (e.g., VP11 to VP14) according to the polarity of each of the pixel voltages (e.g., VP11 to VP14) and the display data (e.g., DS11 to DS14) and the corresponding previous reference data (e.g., DR11*p* to DR14*p*) received by the data channels (e.g., 130_1 to 130_4). Further, in case the preset charging directions of the pixel voltages (e.g., VP11 to VP14) provided by the data channels (e.g., 130_1 to 130_4) corresponding to the same data group (e.g., G11, G12) are completely identical, the polarity determining unit (e.g., 120_1, 120_2) can inverse the polarities of the part of the pixel voltages (e.g., VP11 to VP14) corresponding to the same data group (e.g., G11, G12), so that the preset charging directions of the pixel voltages (e.g., VP11 to VP14) corresponding to the same data group (e.g., G11, G12) can be changed to be not completely identical. Otherwise, the polarity determining unit (e.g., 120_1, 120_2) maintains the polarities of the pixel voltages (e.g., VP11 to VP14).

In other words, when all preset charging directions of the pixel voltages (e.g., VP11 to VP14) of the corresponding data groups (e.g., G11, G12) determined by each of the polarity determining units (e.g., 120_1, 120_2) according to the received display data (e.g., DS11 to DS14) of the coupled data channels (e.g., 130_1 to 130_4) and the previous display data corresponding to the received display data are completely identical, each of the polarity determining units (e.g., 120_1, 120_2) inverts the polarities of the part of the pixel voltages (e.g., VP11 to VP14) provided by the coupled data channels (e.g., 130_1 to 130_4). Otherwise, when the preset charging directions of the pixel voltages (e.g., VP11 to VP14) of the corresponding data groups (e.g., G11, G12) determined by each of the polarity determining units (e.g., 120_1, 120_2) according to the received display data (e.g., DS11 to DS14) of the coupled data channels (e.g., 130_1 to 130_4) and the previous display data corresponding to the received display data are not completely identical, each of the polarity determining units (e.g., 120_1, 120_2) does not invert the polarities of the pixel voltages (e.g., VP11 to VP14) provided by the coupled data channels (e.g., 130_1 to 130_4).

Figure 1B:
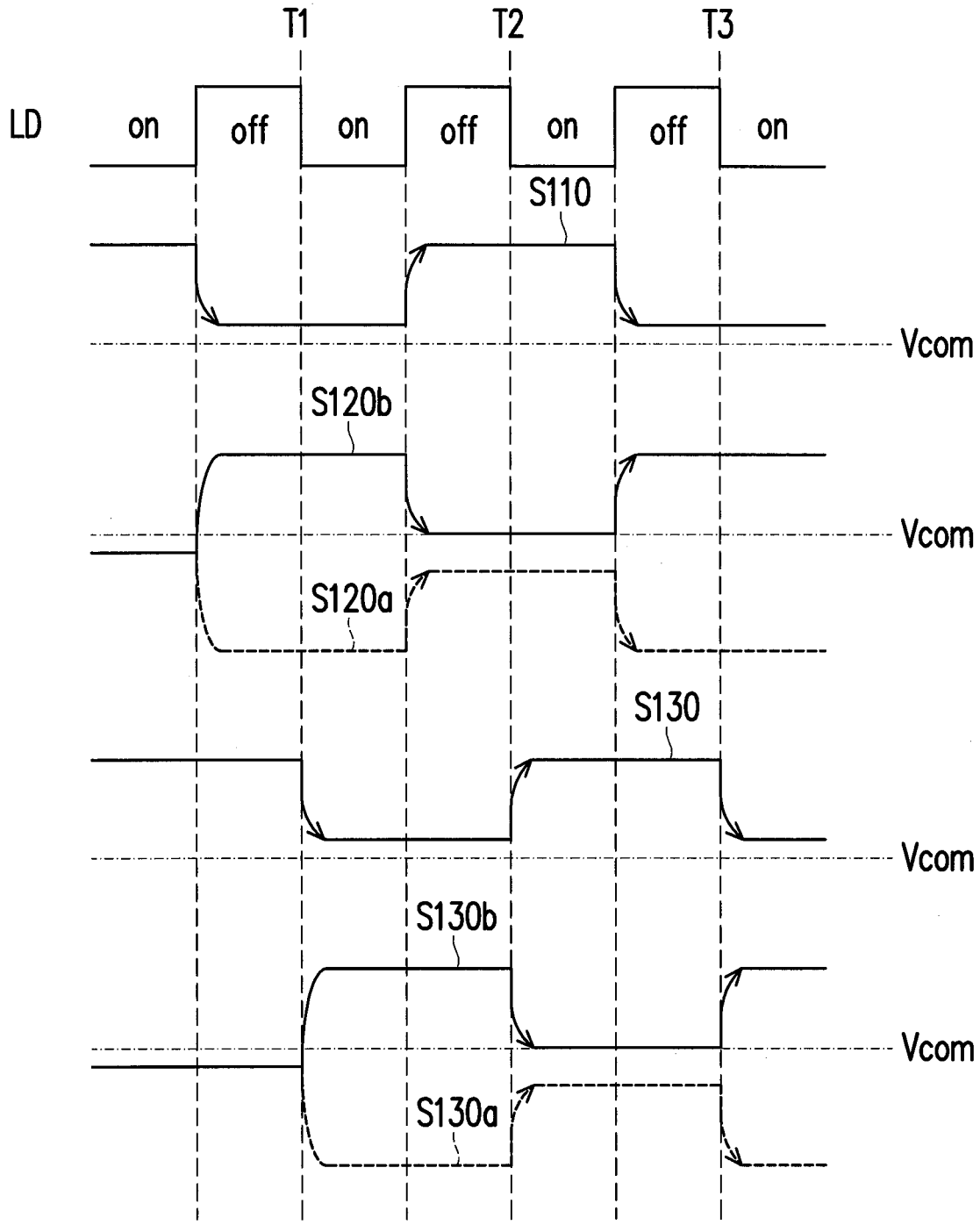
FIG. 1B is a schematic view of waveforms of pixel voltages according to an embodiment of the invention.

FIG. 1B is a schematic view of waveforms of pixel voltages according to an embodiment of the invention. Referring to FIG. 1A and FIG. 1B, in the present embodiment, it is illustrated with the data channels 130_1 and 130_2 of the data group G11 as an example. A curve S110 refers to an internal voltage variation in the data channel 130_1, for example. Curves S120*a* and S120*b* refer to internal voltage variations in the data channel 130_2, for example. A curve S130 refers to a voltage variation of the pixel voltage VP11, for example.

Curves S140*a* and S140*b* refer to voltage variations of the pixel voltage VP12, for example. Therein, according to the latch signal LD, the data channels 130_1 and 130_2 outputs the pixel voltages VP11 and VP12 (represented as on) or does not output the pixel voltages VP11 and VP12 (represented as off), in which the polarity of the pixel voltage VP11 is positive (being greater than a common voltage Vcom) and the polarity of the pixel voltage VP12 is negative (being less than the common voltage Vcom).

In the present embodiment, according to the received display data (DS11, DS12) and the previous received display data (DS11, DS12) of the data channels 130_1 and 130_2, the polarity determining unit 120_1 determines that the preset charging directions of the pixel voltages VP11 and VP12 at a time point T1 are completely identical (refers to charging directions of the curve S130 and S140*a* at the time point T1). In this case, the polarity determining unit 120_1 inverses the polarity of the pixel voltage VP12 through a polarity control signal PC12 (i.e., the polarity of the pixel voltage VP12 is inversed into positive), so that the charging directions of the pixel voltages VP11 and VP12 are completely different (refers to charging directions of the curves S130 and S140*b* at the time point T1). Therein, the preset charging directions are determined based on the polarities of the pixel voltages VP11 and VP12 before the inversion.

In the present embodiment, after the polarity of the pixel voltage VP12 is inversed, the preset charging directions of the pixel voltages VP11 and VP12 are not completely identical (refers to charging directions of the curves S130 and S140*b* at time points T2 and T3), such that the polarity of the pixel voltage VP12 is continuously set to positive. In an embodiment of the invention, the polarity determining unit 120_1 can control only the polarity of the pixel voltage VP12 outputted by the data channel 130_2. However, in other embodiments, the polarity determining unit 120_1 can alternatively control the polarity of the pixel voltage VP11 outputted by the data channel 130_1 and the polarity of the pixel voltage VP12 outputted by the pixel voltage 130_2. For instance, a first polarity inversion inversing the polarity of the pixel voltage VP11, a second polarity inversion inversing the polarity of the pixel voltage VP12, and the rest may be deduced by analogy.

In the present embodiment, each of the data channels (e.g., 130_1 to 130_4) provides a pixel voltage (e.g., VP11 to VP14), and each of the data groups (e.g., G11, G12) includes two data channels (e.g., 130_1 to 130_4). That is, each of the data groups (e.g., G11, G12) corresponds to two pixel voltages (e.g., VP11 to VP14). Also, the polarity determining unit (e.g., 120_1, 120_2) inverses one (i.e., a half of the two pixel voltages) of the polarities of the two pixel voltages (e.g., VP11 to VP14) corresponding to each of the data groups (e.g., G11, G12). However, in other embodiments, each of the data groups (e.g., G11, G12) can correspond to three or more pixel voltages (e.g., VP11 to VP14).

When each of the data groups (e.g., G11, G12) corresponds to an even number (e.g., 4 or 6) of the pixel voltages (e.g., VP11 to VP14), the polarity determining unit (e.g., 120_1, 120_2) can inverse a half (e.g, 2 or 3) of the polarities of the pixel voltages (e.g., VP11 to VP14) corresponding to each of the data groups (e.g., G11, G12). When each of the data groups (e.g., G11, G12) corresponds to an odd number (e.g., 3 or 5) of the pixel voltages (e.g., VP11 to VP14), the polarity determining unit (e.g., 120_1, 120_2) can inverse a number close to a half of the odd number of the pixel voltages (e.g., VP11 to VP14) corresponding to each of the data groups (e.g., G11, G12). For instance, when each of the data groups (e.g., G11, G12) corresponds to three pixel voltages (e.g., VP11 to VP14), the polarity determining unit (e.g., 120_1, 120_2) can inverse one or two (both are close to a half of three, i.e., 1.5) of the pixel voltages (e.g., VP11 to VP14). When each of the data groups (e.g., G11, G12) corresponds to five pixel voltages (e.g., VP11 to VP14), the polarity determining unit (e.g., 120_1, 120_2) can inverse two or three (both are close to a half of five, i.e., 2.5) of the pixel voltages (e.g., VP11 to VP14), and the rest may be deduced by analogy.

Moreover, when each of the data groups (e.g., G11, G12) corresponds to more than three pixel voltages (e.g., VP11 to VP14), the polarity determining unit (e.g., 120_1, 120_2) can inverse a part of the pixel voltages (e.g., VP11 to VP14). For instance, when each of the data groups (e.g., G11, G12) corresponds to three pixel voltages (e.g., VP11 to VP14), the polarity determining unit (e.g., 120_1, 120_2) can inverse one or two of the pixel voltages (e.g., VP11 to VP14). When each of the data groups (e.g., G11, G12) corresponds to four pixel voltages (e.g., VP11 to VP14), the polarity determining unit (e.g., 120_1, 120_2) can inverse one, two or three of the pixel voltages (e.g., VP11 to VP14), and the rest may be deduced by analogy.

Figure 2A:
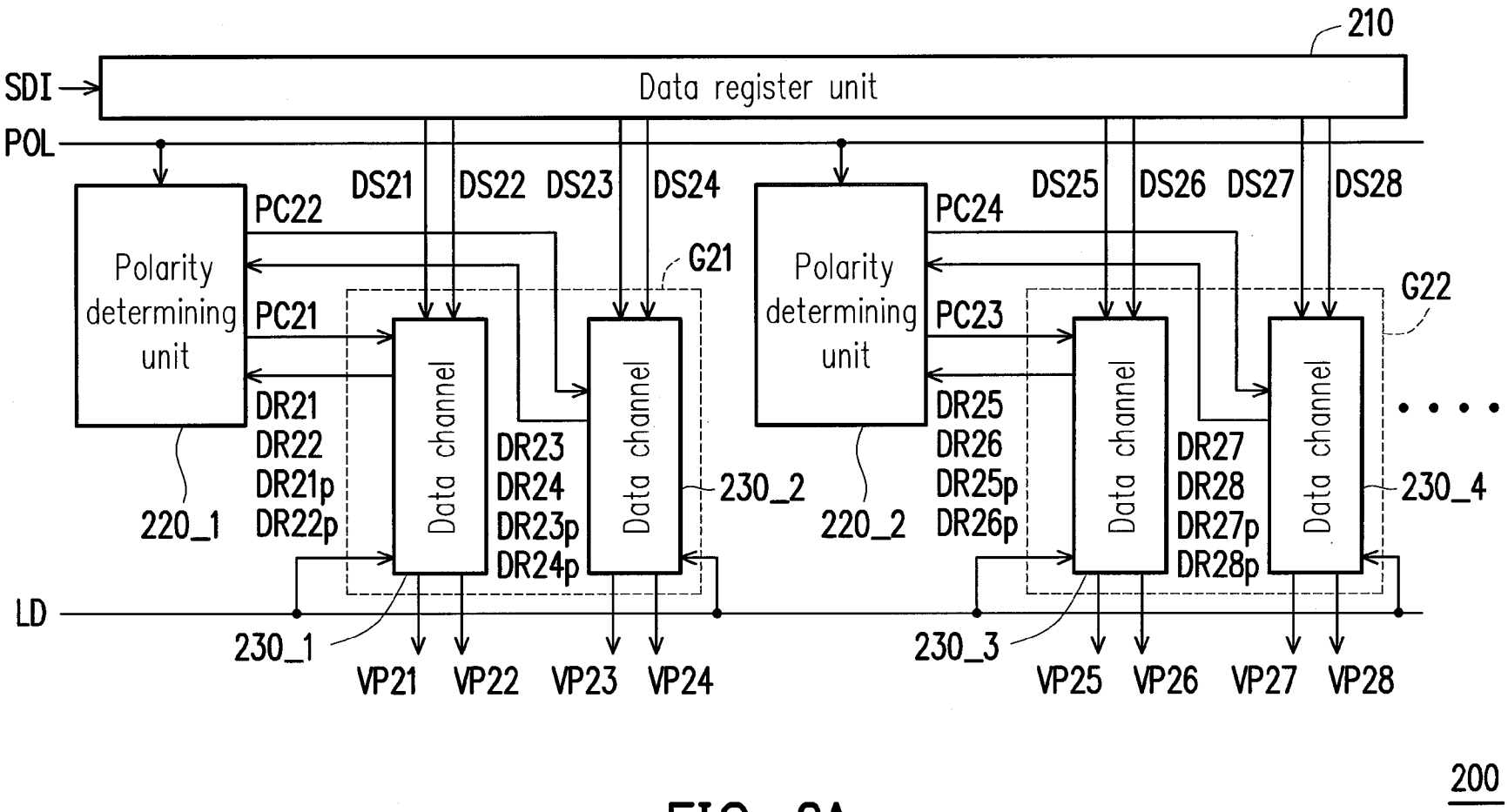
FIG. 2A is a schematic view illustrating a system of a source driver according to another embodiment of the invention.

FIG. 2A is a schematic view illustrating a system of a source driver according to another embodiment of the invention. Referring to FIG. 1A and FIG. 2A, a source driver 200 is similar to the source driver 100, and the same or similar elements are indicated by the same or similar reference numbers. In the present embodiment, the source driver 200 includes a data register unit 210, a plurality of polarity determining unit (e.g., 220_1, 220_2) and a plurality of data channels (e.g., 230_1 to 230_4). The data channels (e.g., 230_1 to 230_4) are grouped into a plurality of data groups (e.g., G21, G22). In the present embodiment, it is illustrated with each of the data groups (e.g., G21, G22) including two data channels (e.g., 230_1 to 230_4) as an example. In other embodiments, each of the data groups (e.g., G21, G22) can include three data channels (e.g., 230_1 to 230_4) or more data channels, and the embodiment of the invention is not limited thereto.

The data register unit 210 receives an image data signal SDI and provides a plurality of display data (e.g, DS21 to DS28). The data channels (e.g., 230_1 to 230_4) is coupled to the data register unit 210 to receive two corresponding display data (e.g., DS21 to DS28) and receive a latch signal LD, so as to provide the two corresponding pixel voltages (e.g., VP21 to VP28) according to the latch signal LD. Therein, polarities of the two pixel voltages (e.g., VP21 to VP28) of each of the data channels (e.g., 230_1 to 230_4) are different from each other, but the embodiment of the invention is not limited thereto.

The polarity determining units (e.g., 220_1, 220_2) are respectively coupled to the data channels (e.g., 230_1 to 230_4) corresponding to different data groups (e.g., G21, G22) and configured to receive a polarity signal POL. Each of the polarity determining units (e.g., 220_1, 220_2) controls the polarities of the pixel voltages (e.g., VP21 to VP24) provided by each of the data channels (e.g., 230_1 to 230_4) through polarity control signals (e.g., PC21 to PC24), and receives reference data (e.g., DR21 to DR28) and previous reference data (e.g., DR21*p* to DR28*p*). Therein, the reference data DR21 can be a part of the display data DS21 (e.g., high bit part) or the entire display data DS21, and the previous reference data DR21*p* can be a part of the previous display data DS21 (e.g., high bit part) or the entire previous display data DS21. Other reference data (e.g., DR22 to DR28) and the previous reference data (e.g., DR22*p* to DR28*p*) may be deduced by analogy, but the embodiment of the invention is not limited thereto.

In the present embodiment, the polarity determining units (e.g., 220_1, 220_2) first determines the polarity (e.g., the positive polarity or the negative polarity) of each of the pixel voltages (e.g., VP21 to VP28) according to the polarity signal POL. Further, each of the polarity determining units (e.g., 220_1, 220_2) then determine whether the polarities of the pixel voltages (e.g., VP21 to VP28) provided by the coupled data channels (e.g., 230_1 to 230_4) require an inversion according the received reference data (e.g., DR21 to DR28) and the previous reference data (e.g., DR21*p* to DR28*p*). In other words, when all preset charging directions of the pixel voltages (e.g., VP21 to VP28) of the corresponding data groups (e.g., G21, G22) determined by each of the polarity determining units (e.g., 220_1, 220_2) according to the received display data (e.g., DS21 to DS28) of the coupled data channels (e.g., 230_1 to 230_4) and the previous display data corresponding to the received display data are completely identical, each of the polarity determining units (e.g., 220_1, 220_2) inverts the polarities of the part of the pixel voltages (e.g., VP21 to VP28) provided by the coupled data channels (e.g., 230_1 to 230_4). Otherwise, when the preset charging directions of the pixel voltages (e.g., VP21 to VP28) of the corresponding data groups (e.g., G21, G22) determined by each of the polarity determining units (e.g., 220_1, 220_2) according to the received display data (e.g., DS21 to DS28) of the coupled data channels (e.g., 230_1 to 230_4) and the previous display data corresponding to the received display data are not completely identical, each of the polarity determining units (e.g., 220_1, 220_2) does not invert the polarities of the part of the pixel voltages (e.g., VP21 to VP28) provided by the coupled data channels (e.g., 230_1 to 230_4).

Figure 2B:
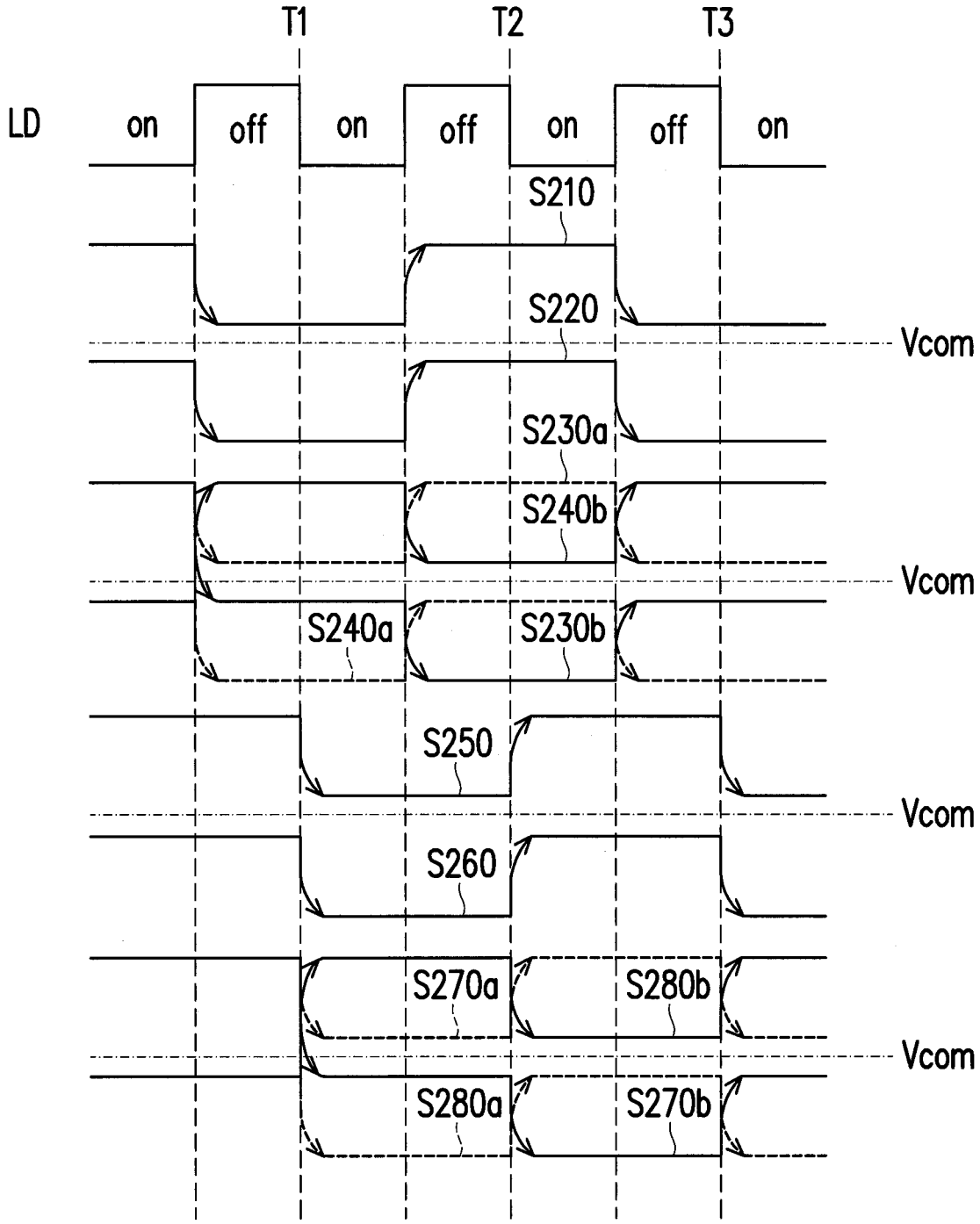
FIG. 2B is a schematic view of waveforms of pixel voltages according to another embodiment of the invention.

FIG. 2B is a schematic view of waveforms of pixel voltages according to another embodiment of the invention. Referring to FIG. 1B, FIG. 2A and FIG. 2B, in which the same or similar elements are indicated by the same or similar reference numbers. In the present embodiment, it is illustrated with the data channels 230_1 and 230_2 of the data group G21 as an example. Curves S210 and S220 refer to internal voltage variations in the data channel 230_1, for example. Curves S230*a*, S230*b*, S240*a* and S240*b* refer to internal voltage variations in the data channel 230_2, for example. A curve S250 refers to a voltage variation of the pixel voltage VP21, for example. A curve S260 refers to a voltage variation of the pixel voltage VP22, for example. Curves S270*a* and S270*b* refer to voltage variations of the pixel voltage VP23, for example. Curves S280*a* and S280*b* refer to voltage variations of the pixel voltage VP24, for example. Therein, according to the latch signal LD, the data channels 230_1 and 230_2 output the pixel voltages VP21 to VP28 (represented as on) or do not output the pixel voltages VP21 to VP28 (represented as off), in which the polarities of the pixel voltages VP21 and VP23 are positive (being greater than the common voltage Vcom) and the polarities of the pixel voltages VP22 and VP24 are negative (being less than the common voltage Vcom).

In the present embodiment, preset charging directions of the pixel voltages VP21 to VP 24 at a time point T1 are completely identical (refers to charging directions of the curves S250, S260, S270*a* and S280*a* at the time point T1). Therefore, the polarity determining unit 220_1 inverses the polarities of the pixel voltages VP23 and VP24 (i.e., the polarity of the pixel voltage VP23 is inversed into negative, and the polarity of the pixel voltage VP24 is inversed into positive), so that the charging directions of the pixel voltages VP21 to VP24 are not completely identical (refers to charging directions of the curves S250, S260, S270*b* and S280*b* at the time point T1). Therein, the preset charging directions are determined based on the polarities of the pixel voltages VP21 to VP24 before the inversion.

In the present embodiment, after the polarities of the pixel voltages VP23 and VP24 are inversed, the preset charging directions of the pixel voltages VP11 to VP24 are not completely identical (refers to charging directions of the curves S250, S260, S270*b* and S280*b* at time points T2 and T3), such that the polarity of the pixel voltage VP23 is continuously set to negative, and the polarity of the pixel voltage VP24 is continuously set to positive. In an embodiment of the invention, the polarity determining unit 220_1 can control only the polarities of the pixel voltages VP23 and VP24 outputted by the data channel 230_2. However, in other embodiments, the polarity determining unit 220_1 can alternatively control the polarities of the pixel voltages VP21 and VP22 outputted by the data channel 230_1 and the polarities of the pixel voltages VP23 and VP24 outputted by the pixel voltage 230_2. That is, a first polarity inversion inversing the polarities of the pixel voltages VP21 and VP22, a second polarity inversion inversing the polarities of the pixel voltages VP23 and VP24, and the rest may be deduced by analogy.

In the present embodiment, each of the data groups (e.g., G21, G22) includes two data channels (e.g., 230_1 to 230_4), and the polarity determining unit (e.g., 220_1, 220_2) inverses the polarities of the pixel voltages (e.g., VP21 to VP28) provided by one (i.e., a half of the two data channels) of the two corresponding data channels (e.g., 230_1 to 230_4) of each one of the data groups (e.g., G21, G22). However, in other embodiments, each of the data groups (e.g., G21, G22) can include three or more data channels (e.g., 230_1 to 230_4).

When each of the data groups (e.g., G21, G22) includes an even number (e.g., 4 or 6) of data channels (e.g., 230_1 to 230_4), the polarity determining unit (e.g., 220_1, 220_2) inverses the polarities of the pixel voltages (e.g., VP21 to VP28) provided by a half (e.g., 2 or 3) of the data channels (e.g., 230_1 to 230_4) included in each one of the data groups (e.g., G21, G22). When each of the data groups (e.g., G21, G22) includes an odd number (e.g., 3 or 5) of data channels (e.g., 230_1 to 230_4), the polarity determining unit (e.g., 220_1, 220_2) inverses the polarities of the pixel voltages (e.g., VP21 to VP28) provided by a number close to a half of the data channels (e.g., 230_1 to 230_4) included in each one of the data groups (e.g., G21, G22). For instance, when each of the data groups (e.g., G21, G22) includes three data channels (e.g., 230_1 to 230_4), the polarity determining unit (e.g., 220_1, 220_2) inverses the polarities of the pixel voltages (e.g., VP21 to VP28) provided by one or two (both are close to a half of three, i.e., 1.5) of the data channels (e.g., 230_1 to 230_4). When each of the data groups (e.g., G21, G22) includes five data channels (e.g., 230_1 to 230_4), the polarity determining unit (e.g., 220_1, 220_2) inverses the polarities of the pixel voltages (e.g., VP21 to VP28) provided by two or three (both are close to a half of five, i.e., 2.5) of the data channels (e.g., 230_1 to 230_4), and the rest may be deduced by analogy.

Moreover, when each of the data groups (e.g., G21, G22) includes more than three data channels (e.g., 230_1 to 230_4), the polarity determining unit (e.g., 220_1, 220_2) inverses the polarities of the pixel voltages (e.g., VP21 to VP28) provided by a part of the data channels (e.g., 230_1 to 230_4). For instance, when each of the data groups (e.g., G21, G22) includes three data channels (e.g., 230_1 to 230_4), the polarity determining unit (e.g., 220_1, 220_2) inverses the polarities of the pixel voltages (e.g., VP21 to VP28) provided by one or two of the data channels (e.g., 230_1 to 230_4). When each of the data groups (e.g., G21, G22) includes four data channels (e.g., 230_1 to 230_4), the polarity determining unit (e.g., 220_1, 220_2) inverses the polarities of the pixel voltages (e.g., VP21 to VP28) provided by one, two or three of the data channels (e.g., 230_1 to 230_4), and the rest may be deduced by analogy.

Figure 3A:
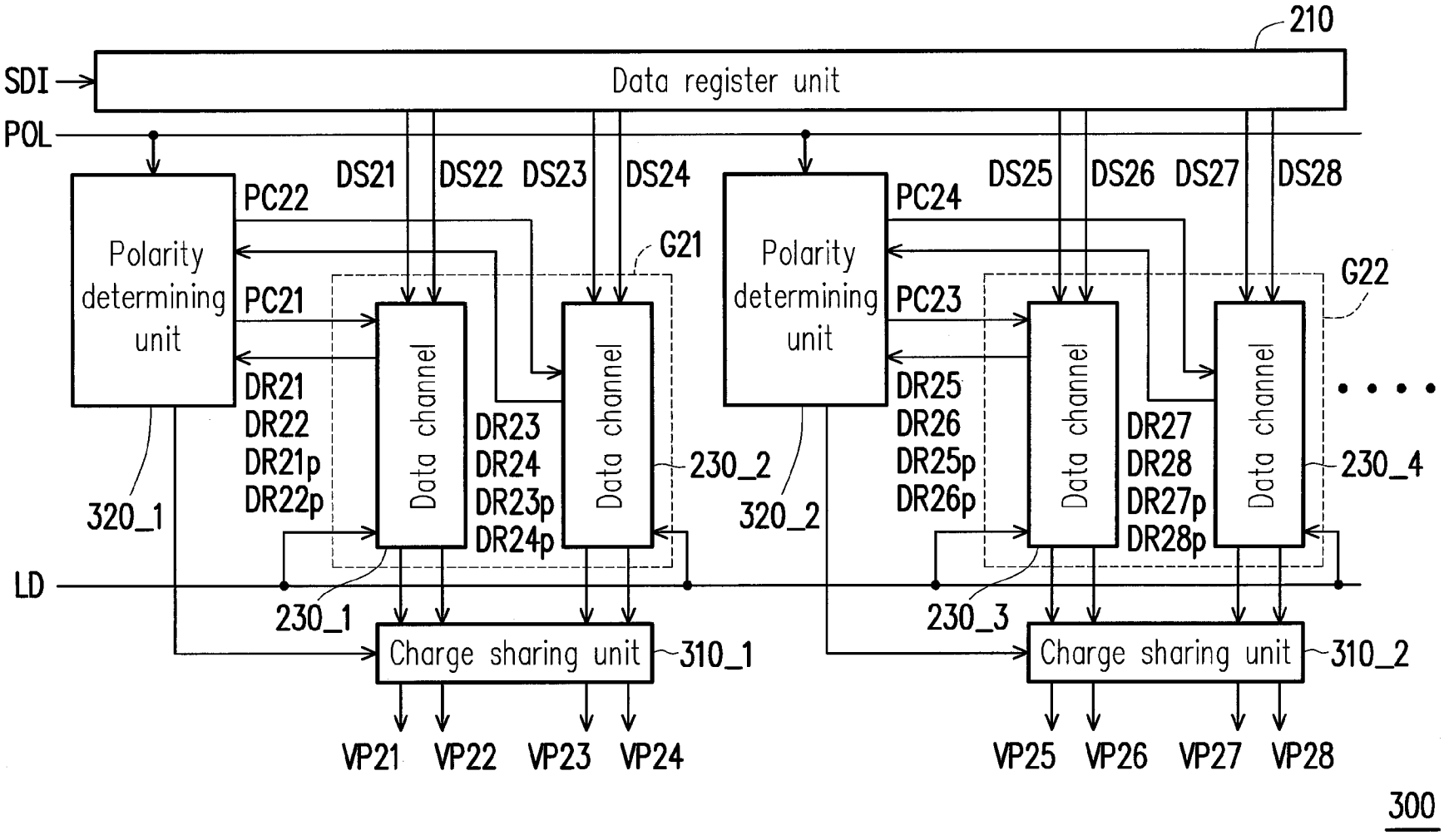
FIG. 3A is a schematic view illustrating a system of a source driver according to yet another embodiment of the invention.

FIG. 3A is a schematic view illustrating a system of a source driver according to yet another embodiment of the invention. Referring to FIG. 2A and FIG. 3A, a source driver 300 is similar to the source driver 200, and the same or similar elements are indicated by the same or similar reference numbers. In the present embodiment, a source driver 300 further includes a plurality of charge sharing units (e.g., 310_1, 310_2), and the polarity determining units (e.g., 320_1, 320_2) are coupled to the corresponding charge sharing unit (e.g., 310_1, 310_2), respectively. The charge sharing unit (e.g., 310_1, 310_2) are coupled to output terminals of the data channels (e.g., 230_1 to 230_4) corresponding to different data groups (e.g., G21, G22). When the polarities of the pixel voltages (e.g., VP21 to VP28) provided by the coupled data channels (e.g., 230_1 to 230_4) are not inversed by each of the polarity determining units (e.g., 320_1, 320_2), this indicates that the preset charging directions of the pixel voltages (e.g., VP21 to VP28) are not completely identical. Therefore, each of the polarity determining units (e.g., 320_1, 320_2) can enable the corresponding charge sharing unit (310_1, 310_2) so as to execute a charge sharing function.

Figure 3B:
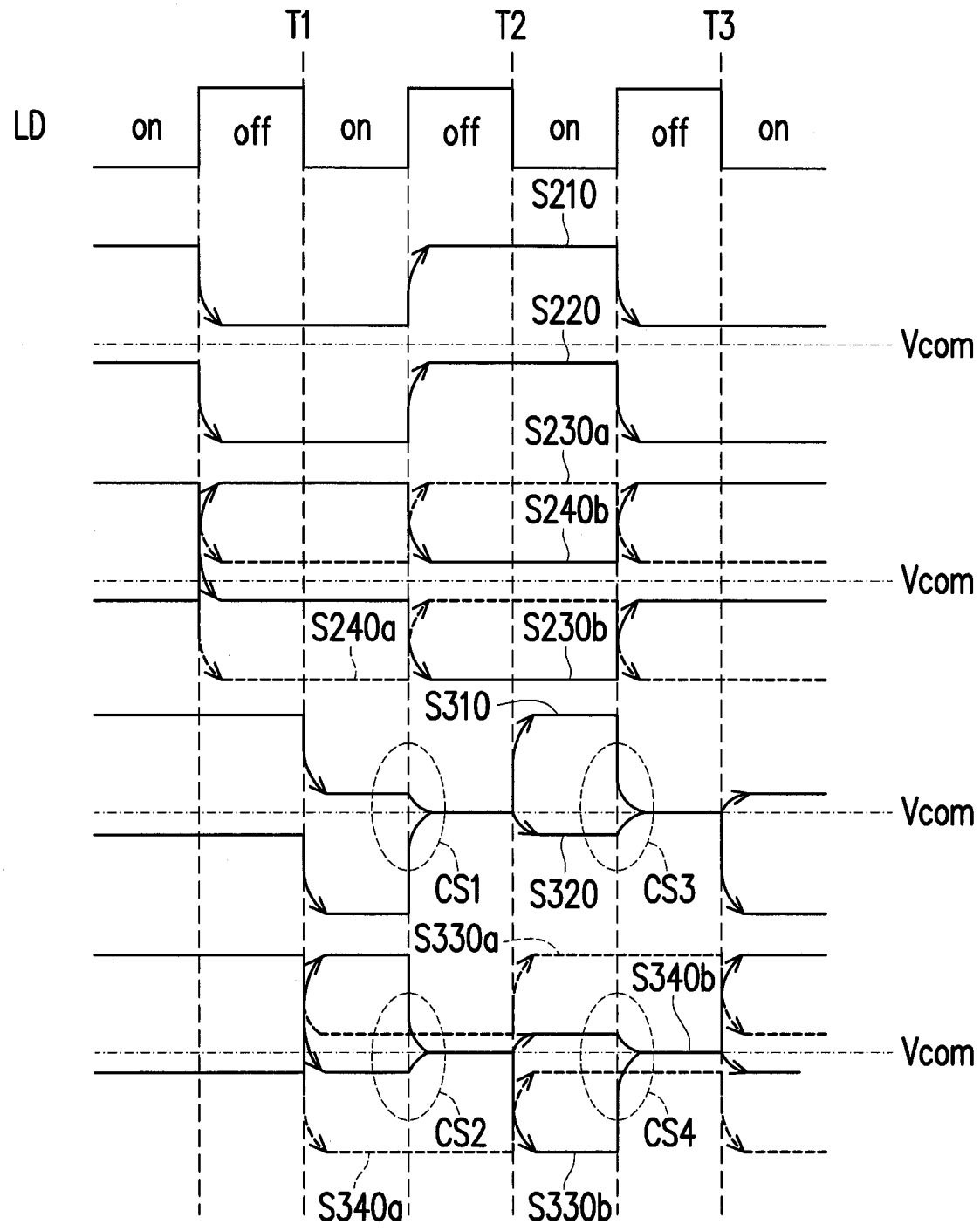
FIG. 3B is a schematic view of waveforms of pixel voltages according to yet another embodiment of the invention.

FIG. 3B is a schematic view of waveforms of pixel voltages according to yet another embodiment of the invention. Referring to FIG. 2B, FIG. 3A and FIG. 3B, in which the same or similar elements are indicated by the same or similar reference numbers. In the present embodiment, it is illustrated with the data channels 230_1 and 230_2 of the data group G21 as an example. A curve S310 refers to a voltage variation of the pixel voltage VP21, for example. A curve S320 refers to a voltage variation of the pixel voltage VP22, for example. Curves S330*a* and S330*b* refer to voltage variations of the pixel voltage VP23, for example. Curves S340*a* and S340*b* refer to voltage variations of the pixel voltage VP24, for example.

In the present embodiment, before the polarity inversion is performed, preset charging directions of the pixel voltages VP21 to VP 24 at a time point T1 are completely identical (refers to charging directions of the curves S310, S320, S330*a* and S340*a* at the time point T1). Therefore, the polarity determining unit 220_1 inverses the polarities of the pixel voltages VP23 and VP24 (i.e., the polarity of the pixel voltage VP23 is inversed into negative, and the polarity of the pixel voltage VP24 is inversed into positive), so that the charging directions of the pixel voltages VP21 to VP24 are not completely identical (refers to charging directions of the curves S310, S320, S330*b* and S340*b* at the time point T1).

Subsequently, after the polarities of the pixel voltages VP23 and VP24 are inversed, the preset charging directions of the pixel voltages VP11 and VP12 are not completely identical (refers to charging directions of the curves S310, S320, S330*b* and S340*b* at time points T2 and T3), such that the polarity determining unit 220_1 maintains the polarities of the pixel voltages VP23 and VP24. In this case, the polarity determining unit 220_1 can control the charge sharing unit 310_1 to be enabled before the time points T2 and T3 (e.g., as shown at sharing time points CS1 to CS4), such that charging amplitudes of the pixel voltages VP21 to VP24 can be reduced through the charge sharing function. In an embodiment of the invention, the polarity determining unit 220_1 can enable the charge sharing unit 310_1 when the preset charging directions of the pixel voltages VP21 to VP24 are reversed to each other (i.e., the pixel voltages with upper charging direction is equal to the pixel voltages with lower charging direction), this can be set by the persons with ordinary skill in the art, and the embodiment of the invention is not limited thereto.

Figure 3C:
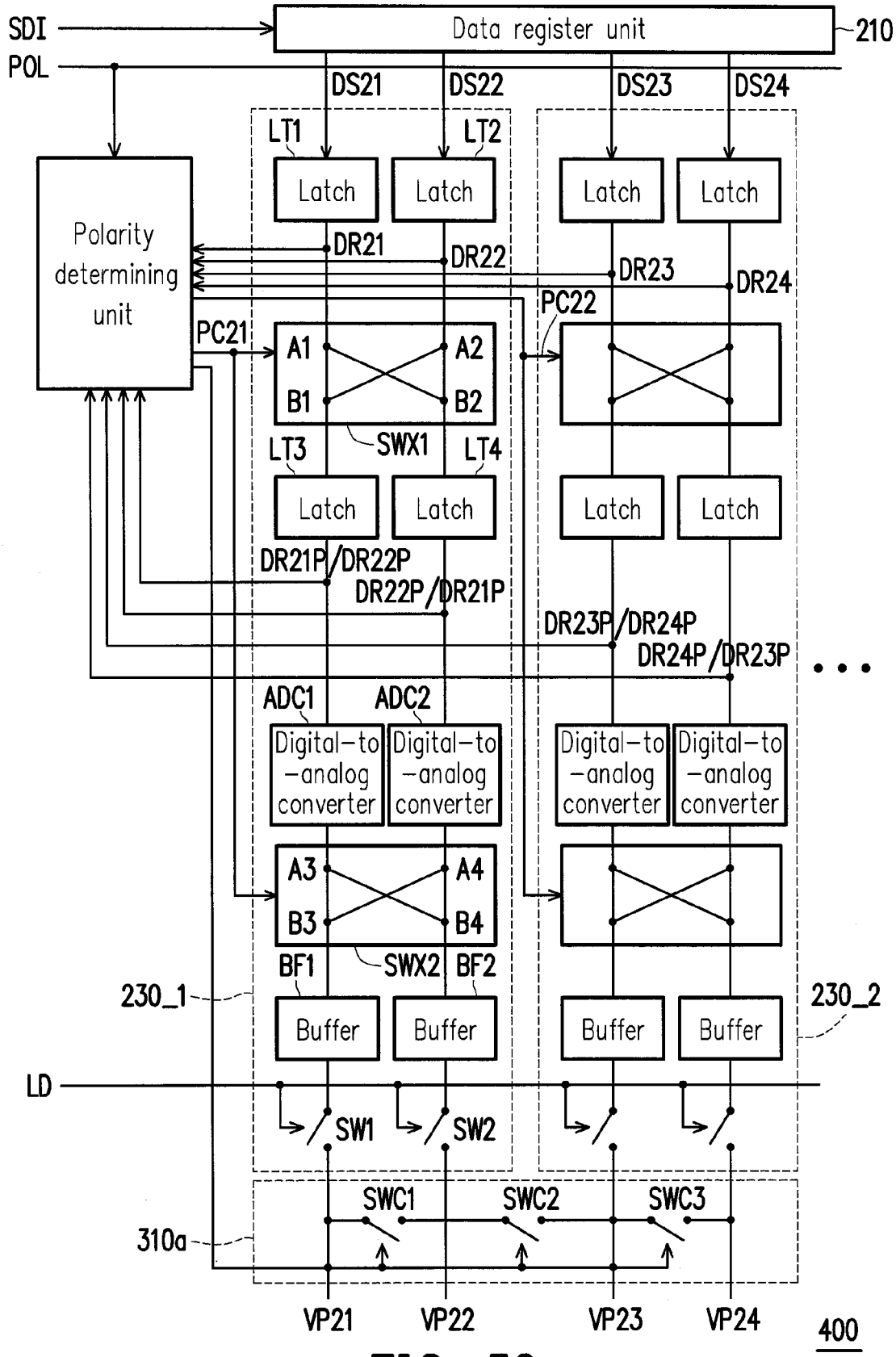
FIG. 3C is a schematic view illustrating a circuit of a source driver according to yet another embodiment of the invention.

FIG. 3C is a schematic view illustrating a system of a source driver according to yet another embodiment of the invention. Referring to FIG. 3A and FIG. 3B, a source driver 400 is similar to the source driver 300, and the same or similar elements are indicated by the same or similar reference numbers. In the present embodiment, the data channel 230_1 includes latches LT1 to LT4, exchanging units SWX1 to SWX2, digital-to-analog converters ADC1 to ADC2, buffers BF1 to BF2 and switches SW1 to SW2. Circuit structure of the data channel 230_2 can refer to the data channel 230_1, thus related description is omitted hereinafter.

An input terminal of the latch LT1 is coupled to the data register unit 210 to receive the corresponding display data DS21, and an output terminal of the latch LT1 is coupled to the corresponding polarity determining unit 320_1 to provide the reference data DR21 corresponding to the display data DS21 received by each of the data channels 230_1. An input terminal of the latch LT2 is coupled to the data register unit 210 to receive the corresponding display data DS22, and an output terminal of the latch LT2 is coupled to the corresponding polarity determining unit 320_1 to provide the reference data DR22 corresponding to the display data DS22 received by each of the data channels 230_1.

The exchanging unit SWX1 has input terminals A1 to A2, output terminals B1 to B2, and receives the polarity control signal PC21 provided by the polarity determining unit 320_1. The input terminal A1 is coupled to the output terminal of the latch LT1; the input terminal A2 is coupled to the output terminal of the latch LT2; the output terminal B1 is coupled to an input terminal of the latch LT3; and the output terminal B2 is coupled to an input terminal of the latch LT4. According to the polarity control signal PC21, the exchanging unit SWX1 controls the input terminals A1 and A2 to couple to the output terminals B1 and B2, respectively, or controls the input terminals A1 and A2 to couple to the output terminals B2 and B1, respectively.

The latch LT3 receives the corresponding display data (e.g., DS21, DS22), and an output terminal of the latch LT3 is coupled to the corresponding polarity determining unit 320_1 to provide the previous reference data DR21*p* or DR22*p* corresponding to the previous display data. The latch LT4 receives the corresponding display data (e.g., DS22, DS21), and an output terminal of the latch LT4 is coupled to the corresponding polarity determining unit 320_1 to provide the previous reference data DR22*p* or DR21*p* corresponding to the previous display data. An input terminal of the digital-to-analog converter ADC1 being coupled to the output terminal of the latch LT3 to receive the corresponding display data (e.g., DS21, DS22) and provide the pixel voltages (e.g., VP21, VP22) having a positive polarity (refers to a first polarity). An input terminal of the digital-to-analog converter ADC2 being coupled to the output terminal of the latch LT4 to receive the corresponding display data (e.g., DS22, DS21) and provide the pixel voltages (e.g., VP22, VP21) having a negative polarity (refers to a second polarity).

The exchanging unit SWX2 has input terminals A3 to A4, output terminals B3 to B4, and receives the polarity control signal PC21 provided by the polarity determining unit 320_1. The input terminal A3 is coupled to an output terminal of the digital-to-analog converter ADC1. The input terminal A4 is coupled to an output terminal of the digital-to-analog converter ADC2. The output terminal B3 is coupled to an input terminal of the buffer BF1. The output terminal B4 is coupled to an input terminal of the buffer BF2. According to the polarity control signal PC21, the exchanging unit SWX2 controls the input terminals A3 and A4 to couple to the output terminals B3 and B4, respectively, or controls the input terminals A3 and A4 to couple to the output terminals B4 and B3, respectively.

The buffer BF1 is configured to buffer the pixel voltage VP21. The buffer BF2 is configured to buffer the pixel voltage VP22. The switch SW1 is coupled to the buffer BF1 and receives the latch signal LD, and outputs the pixel voltage VP21 under control of the latch signal LD. The switch SW2 is coupled to the buffer BF2 and receives the latch signal LD, and outputs the pixel voltage VP22 under control of the latch signal LD.

A charge sharing unit 310*a* includes a plurality of charge sharing switches SWC1 to SWC3 respectively coupled between the output terminals of the data channels 230_1 to 230_2 (corresponding to the same data group G21), and being simultaneously turned on or turned off under control of the corresponding polarity determining unit 320_1.

Figure 4:
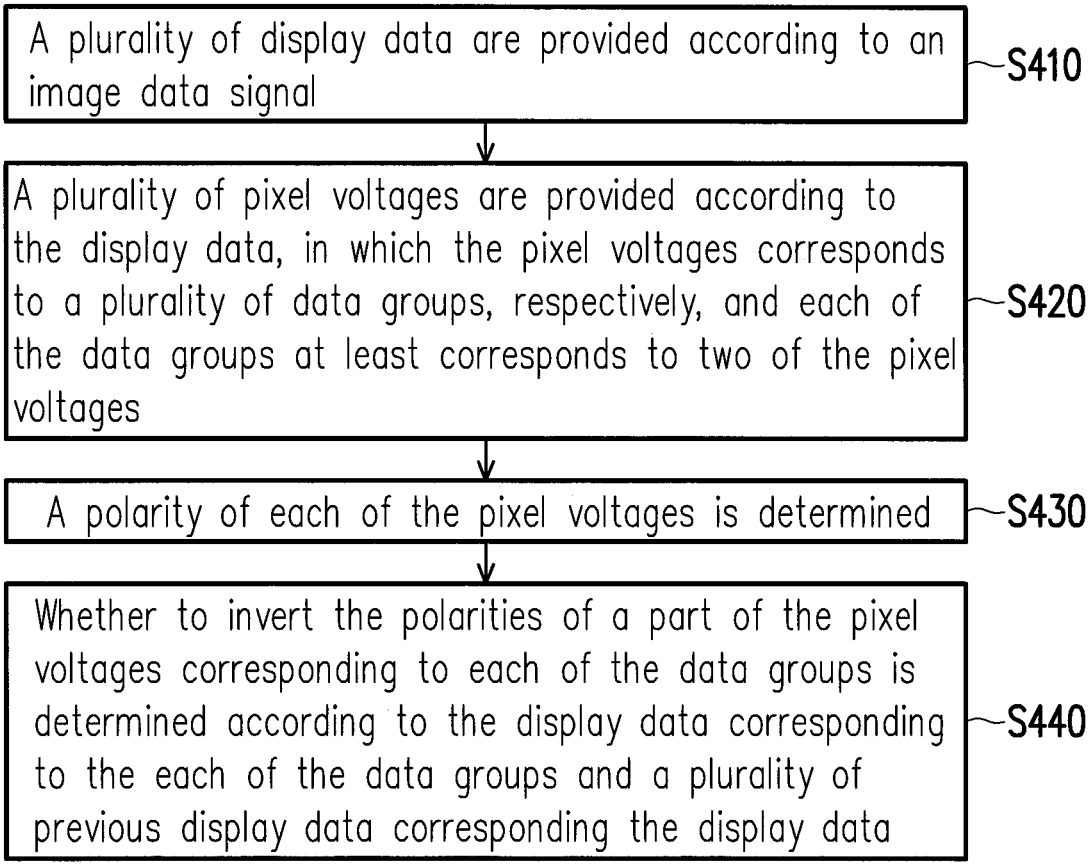
FIG. 4 is a flow chart illustrating a method for determining polarity of pixel voltage of source driver according to an embodiment of the invention.

FIG. 4 is a flow chart illustrating a method for determining polarity of pixel voltage of source driver according to an embodiment of the invention. Referring to FIG. 4, in the present embodiment, the method for determining polarity of pixel voltage of source driver includes the following steps. A plurality of display data are provided according to an image data signal (step S410). A plurality of pixel voltages are provided according to the display data, in which the pixel voltages corresponds to a plurality of data groups, respectively, and each of the data groups at least corresponds to two of the pixel voltages (step S420). A polarity of each of the pixel voltages is determined (step S430). Whether to invert the polarities of a part of the pixel voltages corresponding to each of the data groups is determined according to the display data corresponding to the each of the data groups and a plurality of previous display data corresponding to the display data (step S440). In which, a sequence of steps S410, S420, S430 and S440 is merely an example, the embodiments of the invention are not limited thereto. Further, detailed information regarding steps S410, S420, S430 and S440 may refer to the embodiments as illustrated in FIG. 1A, FIG. 1B, FIG. 2A, FIG. 2B, FIG. 3A, FIG. 3B and FIG. 3C, so related description is omitted hereinafter.

Based on above, in the source driver and a method for determining polarity of pixel voltage thereof, whether to invert the polarities of the part of the pixel voltages corresponding to each of the data groups is determined according to the display data corresponding to the each of the data groups and the previous display data corresponding to the display data. Accordingly, influences of charging the pixel voltages to the common voltage can be reduced. Moreover, the charge sharing function can be executed to the pixel voltages corresponding to each of the data groups when the polarities of the part of pixel voltages of each of the data groups are not inverted, such that charging amplitudes of the pixel voltages can be reduced.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims and their equivalents.

What is claimed is:

1. A source driver, comprising:

a data register unit configured to receive an image data signal and provide a plurality of display data;

a plurality of data channels coupled to the data register unit and configured to receive the display data and provide a plurality of pixel voltages according to the display data, the data channels being grouped into a plurality of data groups and each data group corresponding to at least two of the data channels; and a plurality of polarity determining units coupled to the data channels, each of the polarity determining units being configured to:

determine preset charging directions of pixel voltages provided by the coupled data channels of a corresponding one of the data groups, according to the received display data of the coupled data channels and the previous display data corresponding to the received display data;

determine whether to invert polarities of a part of the pixel voltages provided by the coupled data channels of the corresponding data group, according to the preset charging directions of the pixel voltages of the corresponding data group; and determine whether to enable a charge sharing function according to the preset charging directions of the pixel voltages of the corresponding data groups.

2. The source driver as claimed in claim 1, wherein when the preset charging directions are completely identical, each of the polarity determining units inverts the polarities of the part of the pixel voltages provided by the coupled data channels; and when the preset charging directions are not completely identical, each of the polarity determining units does not invert the polarities of the part of the pixel voltages provided by the coupled data channels.

3. The source driver as claimed in claim 1, wherein when each of the data groups includes an even number of data channels, each of the polarity determining units inverts the polarities of a half of the pixel voltages provided by the coupled data channels.

4. The source driver as claimed in claim 1, wherein when each of the data groups includes an odd number of data channels, each of the polarity determining units inverts the polarities of a n number of the pixel voltages provided by the coupled data channels, wherein n is a positive integer close to a half of a number of the data channels included in each of the data groups.

5. The source driver as claimed in claim 1, wherein each of the data channels respectively receives two display data and respectively provides two corresponding pixel voltages.

6. The source driver as claimed in claim 5, wherein the polarities of the pixel voltages provided by each of the data channels are different from each other.

7. The source driver as claimed in claim 5, wherein each of the data channels comprises:

a first latch, an input terminal of the first latch being coupled to the data register unit to receive the corresponding display data, and an output terminal of the first latch being coupled to the corresponding polarity determining unit to provide the display data received by each of the data channels;

a second latch, an input terminal of the second latch being coupled to the data register unit to receive the corresponding display data, and an output terminal of the second latch being coupled to the corresponding polarity determining unit to provide the display data received by each of the data channels;

a first exchanging unit having a first input terminal, a second input terminal, a first output terminal and a second output terminal, and being configured to receive a polarity control signal provided by the polarity determining unit, the first input terminal being coupled to the output terminal of the first latch, the second input terminal being coupled to the output terminal of the second latch, and according to the polarity control signal, the first exchanging unit controlling the first input terminal and the second input terminal to couple the first output terminal and the second output terminal, respectively, or controlling the first input terminal and the second input terminal to couple the second output terminal and the first output terminal, respectively;

a third latch, an input terminal of the third latch being coupled to the first output terminal to receive the corresponding display data, and an output terminal of the third latch being coupled to the corresponding polarity determining unit to provide the corresponding previous display data;

a fourth latch, an input terminal of the fourth latch being coupled to the second output terminal to receive the corresponding display data, and an output terminal of the fourth latch being coupled to the corresponding polarity determining unit to provide the corresponding previous display data;

a first digital-to-analog converter, an input terminal of the first digital-to-analog converter being coupled to the output terminal of the third latch to receive the corresponding display data and provide the pixel voltages having a first polarity;

a second digital-to-analog converter, an input terminal of the second digital-to-analog converter being coupled to the output terminal of the fourth latch to receive the corresponding display data and provide the pixel voltages having a second polarity;

a second exchanging unit having a third input terminal, a fourth input terminal, a third output terminal and a fourth output terminal, and being configured to receive the polarity control signal, the third input terminal being coupled to the output terminal of the first digital-to-analog converter, the fourth input terminal being coupled to the output terminal of the second digital-to-analog converter, and according to the polarity control signal, the second exchanging unit controlling the third input terminal and the fourth input terminal to couple the third output terminal and the fourth output terminal, respectively, or controlling the third input terminal and the fourth input terminal to couple the fourth output terminal and the third output terminal, respectively;

a first buffer, an input terminal of the first buffer being coupled to the third output terminal to buffer the received pixel voltages;

a second buffer, an input terminal of the second buffer being coupled to the fourth output terminal to buffer the received pixel voltages;

a first switch coupled to the first buffer and receiving a latch signal so as to output the received pixel voltages under control of the latch signal; and a second switch coupled to the second buffer and receiving the latch signal so as to output the received pixel voltages under control of the latch signal.

8. The source driver as claimed in claim 1, further comprising:

a plurality of charge sharing units coupled to the output terminals of the data channels corresponding to different data groups, respectively, and coupled to the corresponding polarity determining unit, wherein each of the polarity determining units determines whether to enable the corresponding charge sharing unit to execute the charge sharing function according to the preset charging directions.

9. The source driver as claimed in claim 8, wherein each of the charge sharing units includes a plurality of charge sharing switches respectively coupled between the output terminals of the data channels of the corresponding data groups, and being simultaneously turned on under control of the corresponding polarity determining unit.

10. A method for determining polarity of pixel voltage of source driver, comprising:

providing a plurality of display data according to an image data signal;

providing a plurality of pixel voltages according to the display data, wherein the pixel voltages corresponds to a plurality of data channels, which are grouped into a plurality of data groups each corresponding to at least two of the data channels;

determining preset charging directions of pixel voltages provided by the coupled data channels of a corresponding one of the data groups, according to the received display data of the coupled data channels and the previous display data corresponding to the received display data;

determining whether to invert the polarities of a part of the pixel voltages of the corresponding data group, according to the preset charging directions of the pixel voltages of the corresponding data group; and determining whether to enable a charge sharing function according to the preset charging directions of the pixel voltages of the corresponding data group.

11. The method for determining polarity of pixel voltage of source driver as claimed in claim 10, wherein determining whether to invert the polarities of the part of the pixel voltages of the corresponding data group, according to the preset charging directions of the pixel voltages of the corresponding data group, comprising:

inverting the polarities of the part of the pixel voltages of each of the data groups when the display data corresponding to each of the data groups and the previous display data corresponding to the display data both showing that preset charging directions of the pixel voltages corresponding to each of the data groups are completely identical; and do not inverting the polarities of the part of the pixel voltages of each of the data groups when the display data corresponding to each of the data groups and the previous display data corresponding to the display data both showing that the preset charging directions of the pixel voltages corresponding to each of the data groups are not completely identical.

12. The method for determining polarity of pixel voltage of source driver as claimed in claim 10, further comprising:

when each of the data groups corresponds to an even number of the pixel voltages, the pixel voltages being inverted is a half of the even number of the pixel voltages.

13. The method for determining polarity of pixel voltage of source driver as claimed in claim 10, further comprising:

when each of the data groups corresponds to an odd number of pixel voltages, the pixel voltages being inverted is a n number of the odd number of the pixel voltages, wherein n is a positive integer close to a half of a number of the pixel voltages corresponding to each of the data groups.

14. The method for determining polarity of pixel voltage of source driver as claimed in claim 10, wherein the polarity of each of the pixel voltages and the polarity of a neighboring pixel voltage are different from each other.

15. The method for determining polarity of pixel voltage of source driver as claimed in claim 10, further comprising:

executing the charge sharing function to the pixel voltages corresponding to each of the data groups when the polarities of the part of pixel voltages of each of the data groups are not inverted.

* * * * *